US005090363A

United States Patent [19]

Duret

[11] Patent Number: 5,090,363

[45] Date of Patent: Feb. 25, 1992

[54] TWO-CYCLE ENGINE WITH PNEUMATIC FUEL INJECTION AND FLOW RESTRICTION IN AT LEAST ONE TRANSFER PASSAGEWAY

[76] Inventor: Pierre Duret, 11, rue du Conservatoire, 75009 Paris, France

[21] Appl. No.: 544,882

[22] Filed: Jun. 28, 1990

[30] Foreign Application Priority Data

Jun. 28, 1989 [FR] France ..... 89 08760

[51] Int. Cl.[5] ..... F02B 33/04

[52] U.S. Cl. ..... 123/73 PP; 123/73 C; 123/531

[58] Field of Search ..... 123/73 PP, 73 A, 73 V, 123/73 C, 65 A, 531, 532, 533, 585

[56] References Cited

U.S. PATENT DOCUMENTS

| | | | |
|---|---|---|---|
| 890,335 | 6/1908 | Claus | 123/73 PP |
| 1,022,390 | 4/1912 | Jennings, Jr. | 123/73 V |
| 2,254,438 | 9/1941 | McCarthy | 123/73 V |
| 3,195,524 | 7/1965 | Heidner | 123/73 A |
| 3,815,558 | 6/1974 | Tenney | 123/73 PP |
| 4,066,050 | 1/1978 | Ford-Dunn | 123/73 PP |
| 4,185,598 | 1/1980 | Onishi | 123/73 A |
| 4,237,831 | 12/1980 | Noguchi et al. | 123/73 A |
| 4,242,993 | 1/1981 | Onishi | 123/73 PP |
| 4,628,888 | 12/1986 | Duret | 123/531 |
| 4,660,514 | 4/1987 | Nerstrom | 123/65 PE |
| 4,796,594 | 1/1989 | Duret | 123/531 |
| 4,899,698 | 2/1990 | Thery | 123/73 A |

FOREIGN PATENT DOCUMENTS

| | | | |
|---|---|---|---|
| 0300014 | 12/1989 | Japan | 123/65 PE |

*Primary Examiner*—Carl Stuart Miller
*Assistant Examiner*—Tom Moulis
*Attorney, Agent, or Firm*—Antonelli, Terry, Stout & Kraus

[57] ABSTRACT

A two cycle engine with pneumatic injection, with the engine including a cylinder, a crankcase communicating with one end of the cylinder, and at least one transfer passageway joining the crankcase to the cylinder. A fuel injector is supplied with compressed air by a container connected to the crankcase and a flow restriction arrangement for restricting the flow of gases is disposed in the transfer passageway. The opening and closing of the flow restriction arrangement is controlled and regulated as a function of at least one engine operating parameter, with the overall result being an improvement in a quality of the fuel injection into the two cycle engines.

13 Claims, 7 Drawing Sheets

TWO-CYCLE ENGINE WITH PNEUMATIC FUEL INJECTION AND FLOW RESTRICTION IN AT LEAST ONE TRANSFER PASSAGEWAY

FIELD OF INVENTION

The invention relates to a two-cycle engine with pneumatic fuel injection and flow restriction in at least one transfer passageway.

BACKGROUND OF INVENTION

Two-cycle engines have one or more cylinders which generally comprise a crankcase, called a pump crankcase, associated with each of the cylinders, with the crankcase communicating with one of the ends of the cylinder and ensuring introduction of fresh gas into the cylinder through at least one passageway and a transfer opening. The piston, which moves in reciprocating fashion in the cylinder, also ensures the intake and compression of fresh gas in the pump crankcase. An intake valve, mounted on the pump crankcase, allows fresh gas to be introduced into the crankcase when the piston moves in the direction opposite to the crankcase, with the fresh gases then being compressed and ensuring closing of the valve when the piston moves in the direction of the crankcase. When the corresponding openings of the cylinder are uncovered by the piston, fresh gases are introduced into the cylinder through the passageways and transfer openings, producing fresh-gas scavenging designed to replace the combusted gases which are discharged through exhaust openings generally arranged in a slightly offset fashion relative to the transfer openings. The piston moves away from the crankcase, compressing the gases contained in the cylinder. Ignition and burning of the mixture thus produce the displacement of the piston toward the crankcase.

In French Patent 2,496,757, it has been proposed to provide pneumatic fuel injection into the cylinder by using the pressure of the fresh gases inside the pump crankcase. To this end, a means for metering the liquid fuel is connected directly to the passageway coming from the pump crankcase. The air compressed in the pump crankcase, transported to the metering device through the passageway, ensures atomization and injection of the fuel inside the cylinder.

Certain improvements have been made to this device and it has been proposed, for example, to provide a container in the passageway connecting the pump crankcase to the injector and a valve at the end of the passageway connected to the pump crankcase. This therefore constitutes a supply of compressed air at a pressure near the maximum pressure in the pump crankcase during the cycle, with the compressed air supply thus serving to atomize the fuel and introduce the atomized fuel into the cylinder in the form of a fuel-air mixture, when the injector is triggered.

One of the disadvantages of two-cycle engines is the loss of power due to the fact that the fresh carburetted gases are not sufficiently separated from the combusted gases inside the cylinder and are consequently responsible for creating conditions unfavorable for the start of combustion.

To overcome this disadvantage, it has been proposed to install a flow-restricting device in the transfer passageways of the engine, in the vicinity of the cylinder, to slow down the emptying of the combusted gases. This results in stratification of the fresh and combusted gases, with the fresh gases being pushed back into the area of the cylinder where injection and ignition take place. However, no such technique has ever been used to restrict the flow of air coming from the crankcase, in the case of a two-cycle engine comprising a pneumatic injection device using the compressed air from the pump crankcase.

In addition, in the case of pneumatic injection using compressed air from the pump crankcase, the pressure differential between the air used for injection and the gases filling the cylinder at the moment of injection can be generally too low to ensure good atomization of the fuel or very high injection efficiency. This drawback remains significant when a container connected to the injector is used, as well as a passageway separated by a valve from the pump crankcase. The pressure in the container, which is higher than the maximum pressure in the pump crankcase, is sometimes insufficiently higher than the pressure in the cylinder at the moment of injection when the cylinder pressure undergoes an increase caused by wave effects in the exhaust pipe.

SUMMARY OF THE INVENTION

The aim underlying the present invention essentially resides in providing a two-cycle engine having a greater output and an improved function due to an improved atomization and injection of fuel into a cylinder.

For this purpose, in accordance with the present invention, a two-cycle engine is provided which comprises at least one cylinder in which a piston moves, with a crankcase communicating with one end of the cylinder and comprising a means for admitting air into the crankcase. At least one passageway admits non-carburetted air into the cylinder and joins the crankcase to a transfer opening of the cylinder. A pneumatic device is provided of ejecting fuel into the cylinder and includes a pneumatic injector. Means are provided for supplying and metering the pneumatic injector with fuel, and a passageway supplies the injector with air under pressure to atomize the fuel. The passageway is connected to the crankcase through a valve and constitutes a compressed-air container connected to the pneumatic injector. An exhaust pipe is located in an offset position along a direction of travel of the piston relative to the transfer opening of the cylinder.

To this end, the engine according to the invention also has, inside the transfer passageway(s) in the vicinity of the cylinder, one or more elements restricting the flow of fresh gases in the cylinder, with their opening and closing controlled and regulated by at least one engine operating parameter.

Thus, a device is used to restrict the passageway of the transfer connection, its opening and closing being controlled and regulated as a function of at least one operating parameter of the engine, to increase the pressure of the air compressed by the piston in the pump crankcase, during pneumatic injection of the fuel into the internal combustion chamber.

Two-cycle engines are known, of the type using cross scavenging, in which all the transfer openings through which the fresh air is admitted into the combustion chamber of the cylinder are grouped on the other side of the cylinder, with these openings being arranged on both sides of a plane of axial symmetry of the cylinder, in essentially symmetrical positions.

The scavenging gas, constituted by the compressed air coming from the pump crankcase, is introduced into the combustion chamber of the cylinder through the transfer openings and scavenges the combustion chamber containing the burned gases, unidirectionally and crosswise.

The scavenging gases can also be deflected by the upper part of the piston, in the form of a deflecting piston, to scavenge the upper part of the combustion chamber before escaping through the exhaust openings.

One of the advantageous features of cross-scavenged engines is the low cost of machining the cylinder block, because the transfer and exhaust ports can be machined in the exterior of the cylinder block.

Another advantageous feature of this type of engine, with multicylinder engines, is that they allow reducing the length of the cylinder blocks, with the various cylinders arranged in line capable of being juxtaposed, with a very slight offset, provided the transfer ports are not located between successive cylinders. The center distance between the cylinders can thus be kept at a value close to that of the cylinder bores.

However, it has never been proposed heretofore for two-cycle engines with multiple cylinders of the cross-scavenging pneumatic injection type to use restricting elements in the transfer passageways. Nor has it been proposed to dispose these restricting elements so as to facilitate engine manufacture and improve engine operation.

The goal of one of the embodiments of the invention is therefore to propose a two-cycle engine comprising at least two cylinders of the cross-scavenging type arranged in line, with the engine comprising means for restricting the transfer passageways located so as to facilitate engine manufacture and to simplify and improve its operation.

For this purpose, the ends of the transfer passageways connected to the chambers of the corresponding cylinders are essentially aligned in a direction parallel to the axis of the cylinder line, and the restricting elements in the transfer passageways are aligned along a single operating axis in a direction parallel to the axis of the cylinder line.

In order better to understand the invention, it will now be described with reference to a nonlimiting example, with reference to the attached drawings, showing a two-cycle engine with flow restriction in the exhaust according to the invention and its operating mode in comparison to the operating mode of a conventional two-cycle engine.

DETAILED DESCRIPTION

Figure 1:
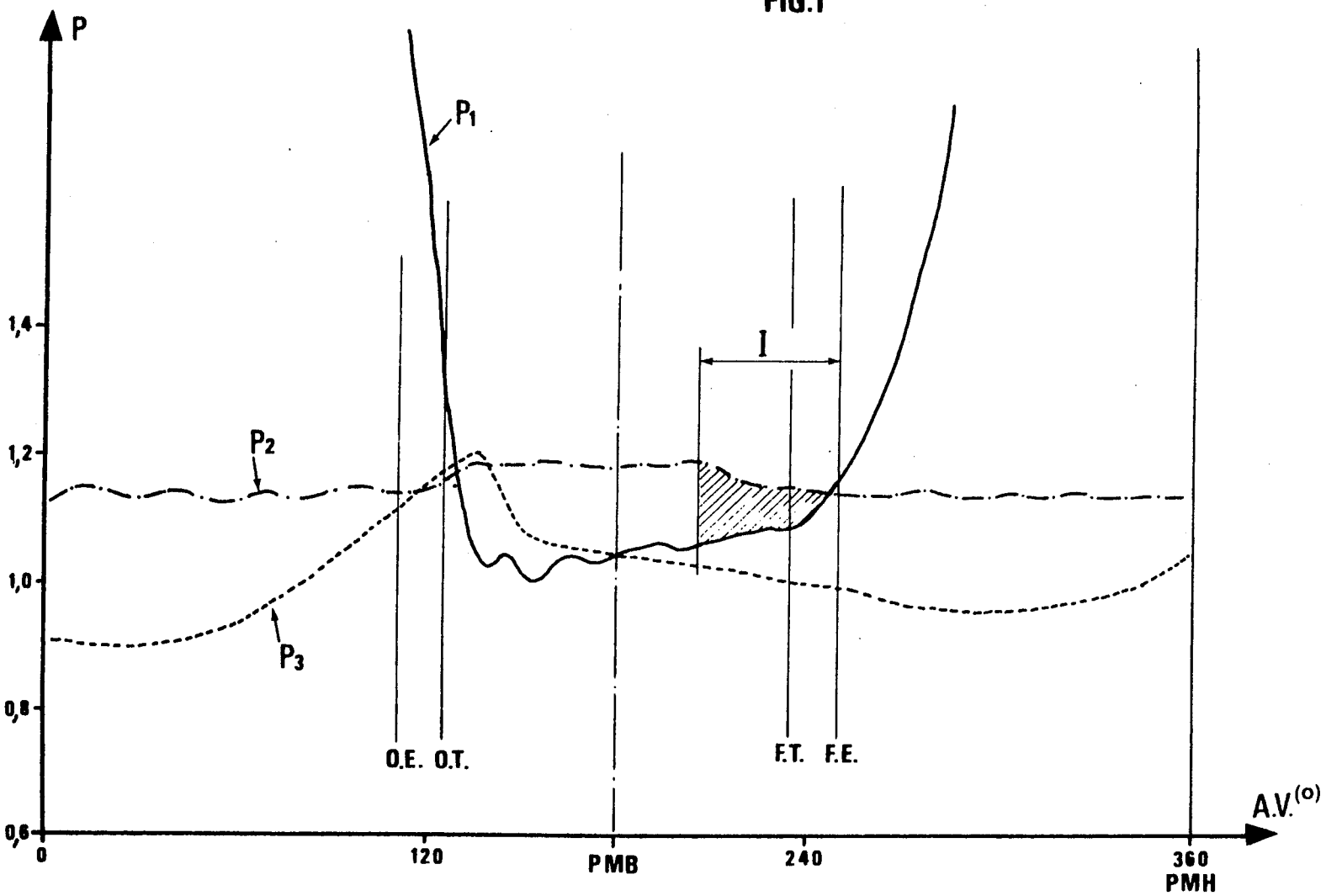
FIG. 1 is a pressure curve diagram recorded during operation of a conventional two-cycle engine with pneumatic injection.
Figure 2:
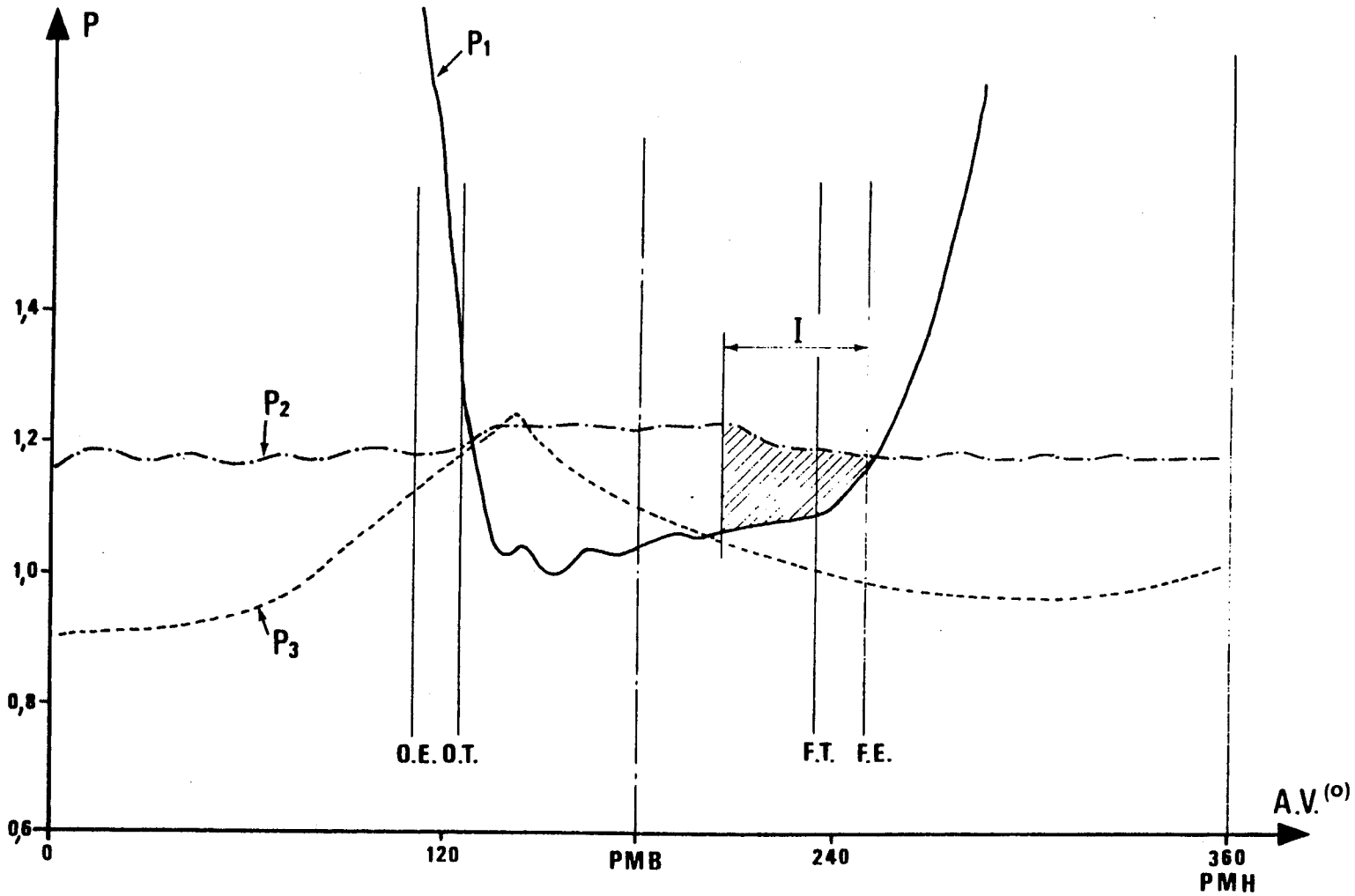
FIG. 2 is a pressure curve diagram recorded during a corresponding operation of a pneumatic injection engine with a flow restriction in the transfer passageway(s) in accordance with the present invention.

In FIGS. 1 and 2, the drawings show pressure variations in the cylinder (curve P1), in the container of the pneumatic injection device (curve P2), and in the transfer passageway (curve P3) as a function of the angle of rotation of the crankshaft, in the case of a conventional engine with pneumatic injection and in the case of an engine according to the present invention, respectively.

Figure 3:
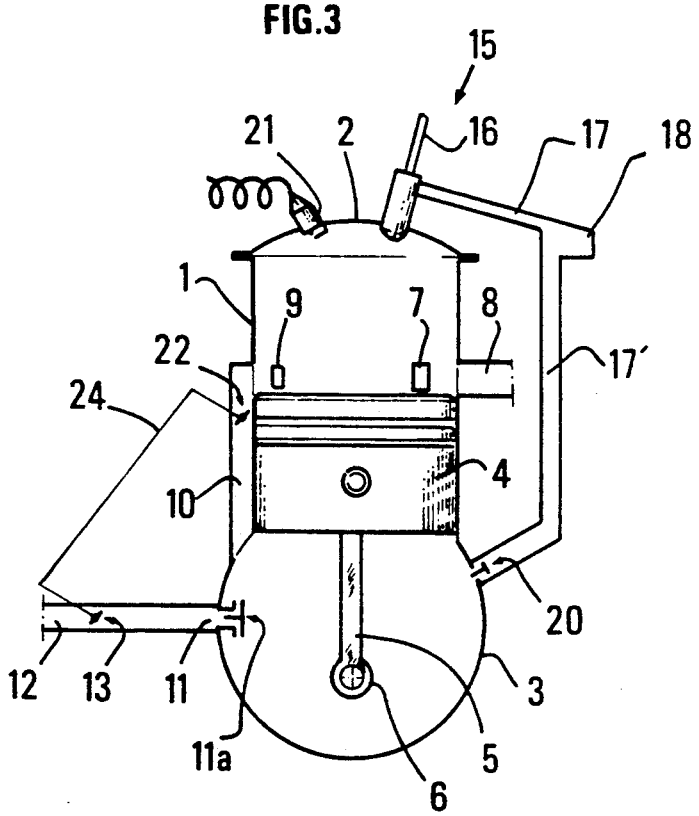
FIG. 3 is a schematic view of a two-cycle engine constructed in accordance with the present invention.

In FIG. 3, the drawing shows in schematic fashion an engine according to the invention with pneumatic injection and with flow restriction in the transfer passageway(s).

An engine according to the prior art whose operating curve is shown in FIG. 1 may be described with reference to the same elements, except for the assembly that regulates the flow restriction admitted by the transfers.

As shown in FIG. 3, engine comprises a cylinder 1 closed at its upper part by a cylinder head 2 and communicating at its lower part with a pump crankcase 3, with the chamber of cylinder 1 and the internal container of pump crankcase 3 being located on either side of piston 4 which reciprocates inside cylinder 1. Piston 4 is connected by a connecting rod 5 to crankcase 6. The wall of cylinder 1 is pierced by openings or exhaust pipes 7 communicating with an exhaust pipe 8.

Ports or transfer openings 9, located offset slightly downward relative to the exhaust ports 7, communicate with a transfer passageway 10 connected to the interior of pump crankcase 3.

Pump crankcase 3 is pierced by an opening 11 provided with a valve **11*a* and communicating with an air inlet passageway 12 in which a butterfly valve 13 capable of closing off the cross section of passageway 12** is located.

A pneumatic injector 15, mounted on cylinder head 2, terminates in the upper part of cylinder 1. Pneumatic injector 15, of the type described and shown in FIG. 7 in French Patent 2,496,757, is supplied with liquid fuel through a passageway 16 and with compressed air by a passageway 17 in which a compressed air storage container 18 is located. The compressed air container 18 is itself connected by a passageway 17' extending passageway 17 to pump crankcase 3. The opening providing communication between crankcase 3 and passageway 17' has a valve 20 which lifts off its seat to provide communication between crankcase 3 and passageway 17' when the pressure exceeds a certain limit in crankcase 3. When valve 20 lifts off its seat, the compressed air in crankcase 3 can fill container 18, recharging it.

Pneumatic injector 15 can comprise a rod controlled by a cam ensuring the start of injection at a specific moment in the operating cycle of the engine. The compressed air from container 18 thus ensures atomization of the fuel supplied to the pneumatic injector by passageway 16 which can comprise a means for metering the fuel and introducing the atomized fuel suspended in the pressurized air, into cylinder 1. A spark plug 21 is mounted on the cylinder head 2.

A flow-restricting element 22, composed for example of a butterfly valve, is mounted inside the transfer passageway near cylinder 1. Element 22 can be connected to butterfly valve 13 in passageway 12 for admitting air into pump crankcase 3 by a connecting and control assembly 24 to open and close element 22 depending on the opening and closing of butterfly valve 13.

Flow-restricting element 22 with its connecting means 24 to butterfly valve 13 ensuring an action proportional to these two flow-restricting elements constitutes the characteristic essential element of a device that permits a significant improvement in the performance of pneumatic injection, as will be explained later on with references to FIGS. 1 and 2.

A two-cycle pneumatic injection engine like that shown in FIG. 3 operates in the following manner:

Assuming that, at an initial moment in time, piston 4 is at top dead center, and some fuel-air mixture is compressed in the upper part of cylinder 1, ignition of this mixture by spark plug 21 will cause combustion, driving piston 4 downward. During its downward movement, cylinder 4 will uncover exhaust openings 7, and the, slightly later, transfer openings 9. The exhaust gases are expelled into passageways 8 and the air compressed by the piston in pump crankcase 3 is driven into the cylinder through transfer passageway 10.

The air pressure in pump crankcase 3 rises to a maximum, with valve 11*a* closed. When the air pressure in pump crankcase 3 exceeds that in the container, valve 20 opens and container 18 is refilled with air at a pressure close to the maximum pressure in pump crankcase 3.

Valve 20 closes again and piston 4, having arrived at bottom dead center, then begins to ascend. Fuel is injected at the top of the cylinder by injector 15 under the influence of the compressed air in chamber 18. As it moves upward, piston 4 covers transfer openings 9 and exhaust openings 7 and provides for compression of the fuel-air mixture. Valve 11*a* opens and air is admitted into pump crankcase 3.

FIGS. 1 and 2 show the variation in pressure in the cylinder, in the container of the pneumatic injection device and in the transfer passageway as a function of crankcase angle for a complete cycle, in the case of a conventional two-cycle engine with pneumatic injection and in the case of a two-cycle engine according to the invention, respectively.

In FIGS. 1 and 2, the abscissa plots the bottom dead center and top dead center positions (BDC and TDC, respectively). The positions corresponding to the opening and closing of transfer openings or ports 9 and the positions corresponding to opening and closing of exhaust openings or ports 7 have been indicated.

In the case of an engine according to the prior art (FIG. 1), the pressure P1 in the cylinder falls rapidly as the piston moves toward bottom dead center, with its displacement accompanying the opening of the exhaust (OE) and transfer (OT). It simultaneously results in an escape of the exhaust gases into passageway 8 and scavenging of the cylinder by the compressed air in pump crankcase 3.

The pressure P2 in the container is established at the beginning of scavenging at a maximum value essentially corresponding to the maximum pressure in pump crankcase 3, which likewise corresponds to the maximum pressure on curve P3.

Injection (I) is triggered at the end of scavenging, this period being favorable because of the relatively low pressure in the cylinder and because it is also less likely to involve entrainment of the fuel by the exhaust with the burned gases.

Injection is provided by compressed air P2 which fills container 18. The degree of atomization of the fuel and of injection, at the moment of opening of injector rod 15, depends on the pressure differential between container 18 and the cylinder.

In the diagram of FIG. 1, this pressure differential, which varies during injection, corresponds to the vertical distance between curves P1 and P2. The area of the shaded zone between these curves during injection (1) gives some idea of the energy that can be used for injection. The pressure differential $\Delta P \approx P2 - P1$ decreases during injection and disappears near closing of exhaust FE. Pressure P1 initially increases slowly, then rapidly, at the end of scavenging, while pressure P2 falls during injection, because container 18 is drained of a portion of the compressed air it contains.

In FIG. 2, the operating curve of a two-cycle engine according to the invention is shown, comprising a restricting element 22 in the transfer passageways.

Pressure P3 in the transfer passageway upstream of restricting element 22 undergoes a greater increase during crankcase compression because of the difficulty the crankcase experiences in emptying into the cylinder.

The air contained in the crankcase, subjected to compression during the descent of piston 1, therefore reaches maximum pressure during the initial phase of scavenging. This pressure is higher than where there is no flow restriction in the transfer passageway. Container 18 is filled with compressed air at a pressure close to the maximum on curve P2 in FIG. 2 and is higher than in the case of a conventional engine.

Consequently, the pressure differential $\Delta P \approx P2 - P1$ is greater throughout injection phase I in an engine according to the invention (FIG. 2) then in an engine according to the prior art (FIG. 1). This favorable effect is obtained by a higher pressure P2, at least at the beginning of injection.

In a conventional engine, at the same operating point, the pressure in the cylinder is at a minimum during injection, on the order of 1.05 bars.

The charging pressure P2 of the container at the beginning of injection is 1.18 bars in the conventional engine (FIG. 1) and 1.25 bars in the engine according to the invention.

Consequently, in the case of the conventional engine $\Delta P = 1.18 - 1.05 = 0.13$ bar and in the case of an engine according to the present invention delta $P = 1.25 - 1.05 = 0.20$ bar, at the beginning of injection.

Thus, a significant gain in the pressure differential $\Delta P$ is obtained, which translates to a significant increase in the quantity of air arriving at the injector and serving to atomize the fuel, as well as a significant increase in the speed of this air which performs atomization and injection.

The fuel is thus more finely atomized and introduced under better conditions into the interior of the cylinder.

Adjustment of the opening or closing position of the restriction 22 as a function of the corresponding position of intake butterfly valve 13 is designed to produce a maximum pressure differential $\Delta P$ throughout the injection phase, resulting in an injection energy, represented by the shaded zone in FIG. 2, which is as high as possible.

In the embodiment shown in FIG. 3, the position of butterfly valve 13 varies with the load on the engine, so that connecting assembly 24 makes it possible to adjust the position of restricting element 22 as a function of the load on the engine as well.

Generally speaking, the transfer flow restricting element can be constituted by any butterfly valve, flap, or plug located inside the exhaust duct or near the exhaust ports through the wall of the cylinder.

It would also be possible to use an element with ports rotating around the axis of the cylinder.

These blocking elements could be connected mechanically by any means such as rods articulated to butterfly valves or plugs for admitting air into the crankcase, the position of said butterflies or plugs depending on the load of the engine.

It is likewise possible to use motorized blocking elements with opening and closing commands given by electronic means using, as input data, parameters that translate the speed of and load on the engine. These parameters can be of various kinds and the corresponding data obtained by these sensors may relate, for example, to the degree of opening of the butterfly valve or plug of the intake passageway or to the intake vacuum level.

Other engine parameters which translate its speed and load can also be taken into account, among them in the intake air temperature, the temperature of the water that cools the engine, or various pressures in the engine whose values are compared to atmospheric pressure.

It is apparent that the engine according to the invention could also comprise any type of restricting element for the transfer flow, whose opening and closing are controlled by any means of a mechanical, electronic, or other type.

Finally, the engine according to the invention could comprise any number of cylinders arranged in any manner.

Pneumatic injector 15 could comprise a valve controlled mechanically, electronically, or electromechanically, an automatic valve, a rotating plug, or any other equivalent means.

Figure 4:
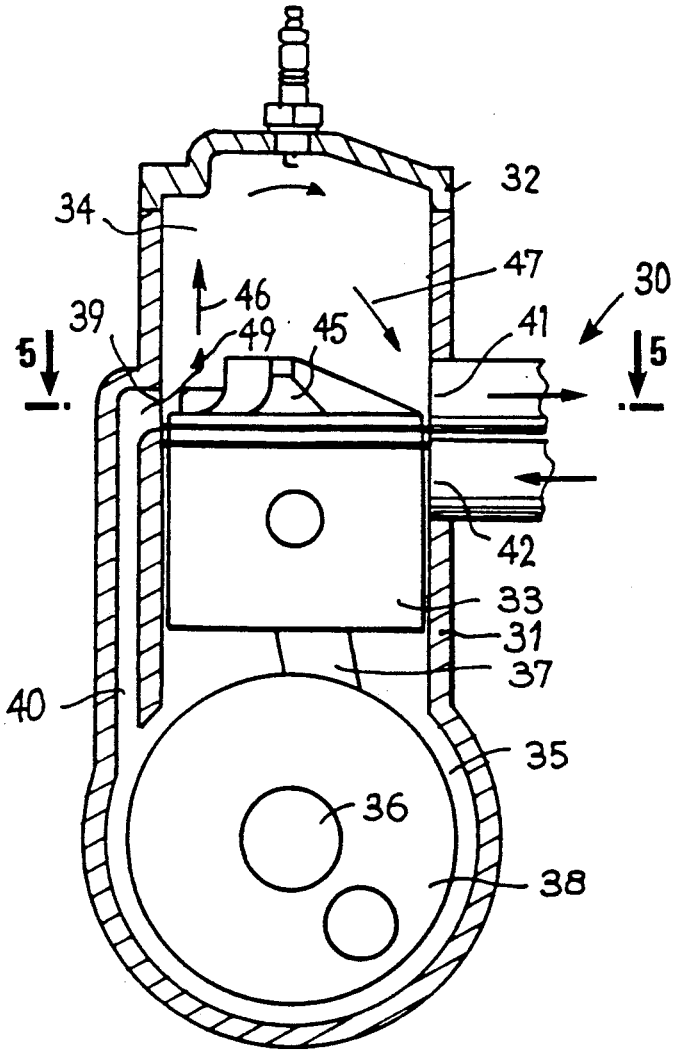
FIG. 4 is a cross-sectional view taken along a vertical plane of symmetry through one cylinder of a two-cycle engine with cross scavenging.
Figure 5:
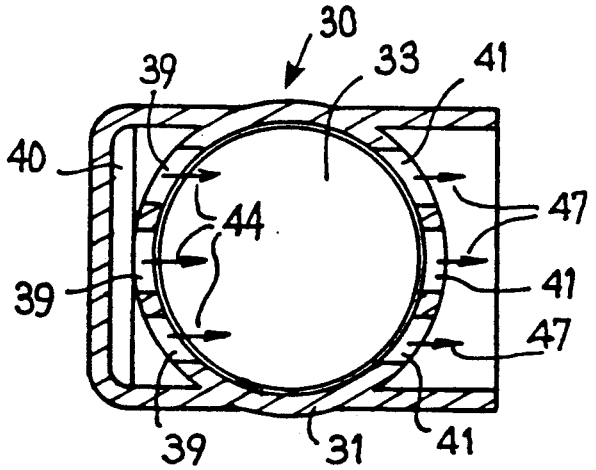
FIG. 5 is a cross-sectional view taken along the line 5—5 in FIG. 4.

In FIGS. 4 and 5, a cylinder 30 of a two-cycle engine with cross scavenging of the classical type is shown.

Cylinder 30 comprises a cylinder block 31 closed at its upper end by a cylinder head 32 and machined to form a bore in which a piston 33 moves. Combustion chamber 34 of the cylinder is delimited by the upper surface of piston 33 and by the internal surface of cylinder head 32. The piston 33 is connected to an engine crankshaft 36 by a connecting rod 37.

Cylinder 30 comprises, as an extension of the bore in which piston 33 moves, a pump crankcase 35 traversed by the engine crankshaft 36, integral with a flywheel 38.

The wall of the cylinder is traversed by transfer openings 39 connected by a transfer passageway 40 to pump crankcase 35.

Exhaust openings 41 likewise traverse the wall of cylinder 30, at positions slightly offset relative to the transfer openings in the axial direction of cylinder 30.

As the piston 33 move in the bore of the cylinder 30, the piston 33 covers and uncovers transfer openings 39 and the exhaust openings 41.

The wall of cylinder 30 is likewise traversed by an opening 42 where an air intake passageway is mounted in pump crankshaft 35 provided with a valve, not shown.

When piston 33 moves toward top dead center, it produces a certain vacuum in pump crankcase 35 and atmospheric air is admitted through opening 42 following opening of the valve.

As piston 33 moves toward bottom dead center, it compresses the air contained in the pump crankcase to a certain degree, so that a portion of this compressed air is driven into transfer passageway 40 and introduced into combustion chamber 34 through openings 39 in the direction of the arrows 44 in FIG. 5.

In the case of a cylinder of a two-cycle engine with cross scavenging as shown in FIGS. 4 and 5, transfer openings 39 are all located on the same side of an axial plane of symmetry of the cylinder and exhaust openings 41 are located opposite them on the other side of the axial plane of symmetry of cylinder 30.

In addition, the piston 33 comprises at its upper end an extension of shaped profile 45 machined into curved and inclined surfaces to constitute an air-flow deflector for the air admitted into chamber 34 through transfer openings 39.

The scavenging air from chamber 34 is directed upward in the direction of the arrow 46 in FIG. 4 to scavenge the upper part of combustion chamber 34.

The combusted gases in the combustion chamber are exhausted through the exhaust openings 41 located opposite transfer openings 39 in the direction of the arrows 47 in FIG. 4.

This arrangement of transfer openings 39 and exhaust openings 41 as well as the use of a deflector 45 thus provides efficient cross scavenging of the combustion chamber and especially of an upper part thereof.

In the case of a pneumatic injection engine, after the combustion chamber has been scavenged and filled with fresh air, atomized fuel is introduced in a stream of compressed air by an injector located in the upper part of the cylinder. The compressed air used generally comes from pump crankcase 35 or from a container supplied with compressed air from the pump crankcase 35.

The fuel is atomized and the carburetted mixture injected into the combustion chamber under conditions which improve as a direct function of the pressure of the compressed air available in the pump crankcase 35 at the moment pneumatic injection increases.

In order to increase this injection process, a device is used to restrict the clearance for compressed air in transfer passageway 40 to reduce the air flow prior to pneumatic injection, thus increasing the pressure of the air available for pneumatic injection in the pump crankcase 35.

Figure 6:
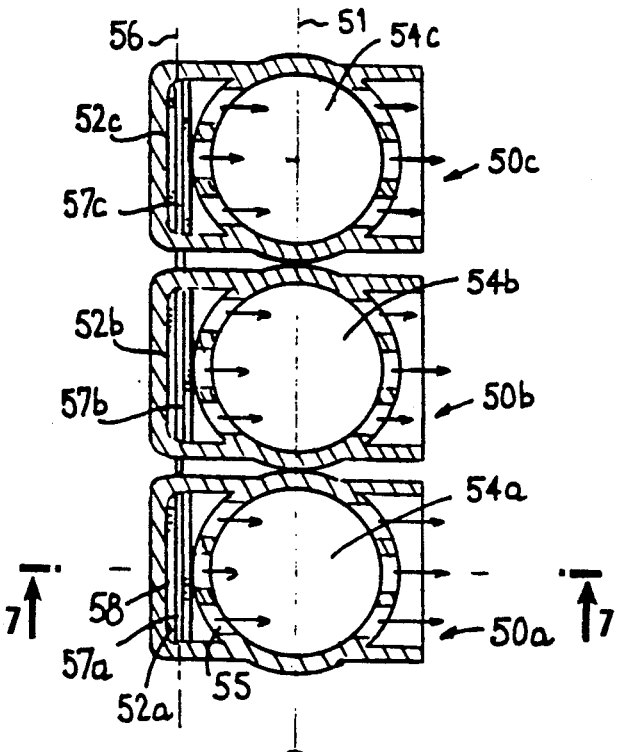
FIG. 6 is a cross-sectional view taken along the line 6—6 in FIG. 7 though a multi-cylinder engine in accordance with the present invention.

In the case of a multicylinder two-cycle engine with cross scavenging, as shown in FIG. 6, successive cylinders 50*a*, 50*b*, and 50*c* may be arranged in line and juxtaposed with a reduced distance between their axes, and with the transfer openings 55 of the successive cylinders, all located on the same side of a vertical plane passing through axis 51 of the line of cylinders, being completely outside the zones located between successive cylinders 50*a*, 50*b*, and 50*c*. This produces a multicylinder engine with a perfectly compact design.

Such an arrangement of the successive cylinders of multicylinder engines makes it possible to obtain an center-to-center ratio between the cylinders and passageways of the cylinders which is less than 1.15.

In addition, according to the invention, the ends of transfer passageways 52*a*, 52*b* and 52*c* communicating with combustion chambers 54*a*, 54*b*, and 54*c* of the cylinders, through corresponding transfer openings 55, can be aligned in a direction 56 parallel to the axis of the line of cylinder 51 and located in a position that is lateral relative to the cylinder line.

Restricting elements 57*a*, 57*b* and 57*c* of the transfer passageways can be located in each of end areas of the transfer passageways 52*a*, 52*b*, 52*c* and aligned in a direction 56 parallel to the axis of cylinder line 51.

In the embodiment of FIG. 6, each of restricting elements 57*a*, 57*b* and 57*c* is constituted by one end of a shaft aligned in the direction 56 and mounted to rotate around its geometric axis in the cylinder block and bearing a butterfly valve 58 to restrict the passage of compressed air, at the end of the corresponding transfer passageway 52*a*, 52*b*, or 52*c*.

Preferably, the ends of restricting elements 57*a*, 57*b* and 57*c*, each having a butterfly valve 58 to restrict the passage of compressed air, are integral with a single shaft for their operation or are constituted by successive parts of this single shaft arranged in the direction 56.

The single operating shaft can be located in an angular position determined as a function of an operating parameter of the engine, for example, the operating shaft that regulates all the butterfly valves 58 could be connected to a device for regulating the admission of air to the pump crankcases of the cylinders.

Figure 7:
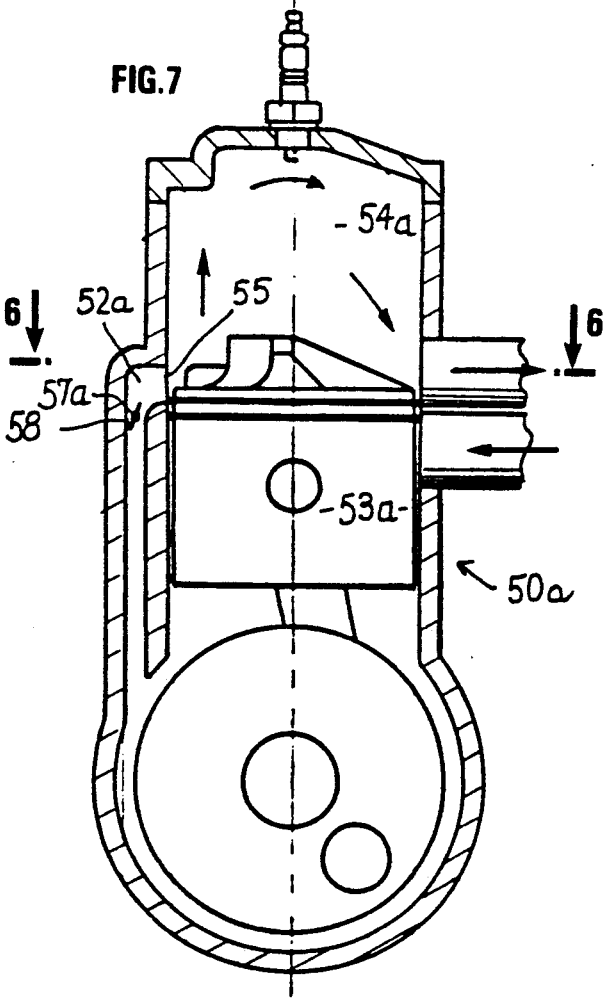
FIG. 7 is a cross-sectional view taken along the line 7—7 in FIG. 6.

As shown in FIG. 7, when the air admitted to the pump crankcase is compressed by piston 53*a* to scavenge chamber 54*a* of cylinder 50*a*, butterfly valve 58 of the restricting element 57*a* for restricting the passage of compressed air being in a partially closed position during scavenging, the restriction of compressed air flow in the transfer passageway makes it possible to increase the pressure of the compressed air in the pump crankcase, available for use in pneumatic injection of the fuel into combustion chamber 54*a* after the latter is refilled with fresh air.

The same advantages are obtained in the corresponding functioning phases of cylinders 52*b* and 52*c*.

Figure 8:
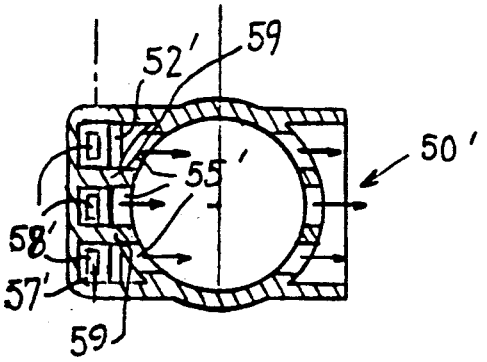
FIG. 8 is a cross-sectional view of a cylinder of an engine according to a variation of the embodiment of FIG. 6.

FIG. 8 shows one embodiment of a cylinder 50' of a two-cycle engine with cross scavenging, comprising a means of restricting the passage of compressed air into the cylinder chamber, through its transfer openings 55'.

In its end area communicating with transfer openings 55',transfer passageway 52' is divided into several parts by partitions 59, with each part of the passageway 52' being located opposite a transfer opening 55'.

In this case, means 57' for restricting the passage of compressed air in the end portion of passageway 52' is constituted by one shaft end rotatably mounted in the cylinder block and in the partitions 59, and having a butterfly valve 58' on each of its successive sections, located in a portion of the end of the transfer passageway 52' opposite a transfer opening 55'.

The operation of a multicylinder engine comprising plurality of cylinders such as cylinder 50' arranged in line is identical to the functioning of a multicylinder engine as shown in FIGS. 6 and 7.

Figure 9:
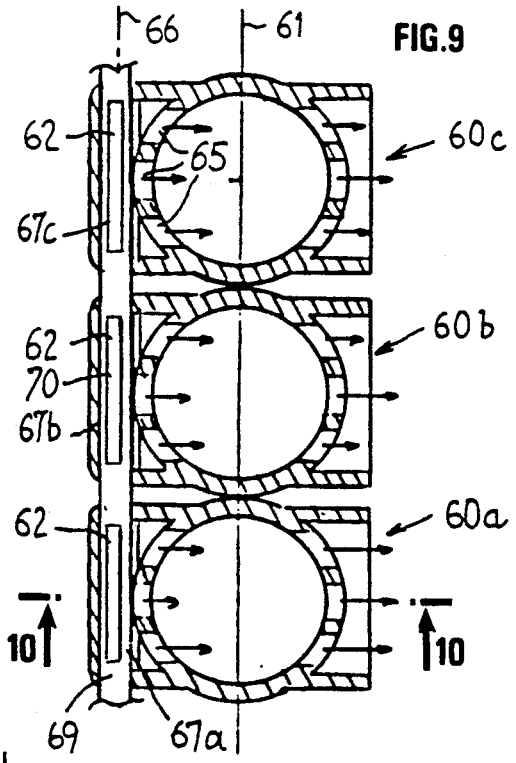
FIG. 9 is a cross-sectional view taken along the line 9—9 in FIG. 10 through an engine in accordance with the present invention.

In FIG. 9, another embodiment of a multicylinder engine with cross scavenging according to the invention is shown, comprising means for restricting the passage of compressed air in the end areas of the transfer passageways of each of the cylinders.

The engine comprises successive cylinders 60*a*, 60*b* and 60*c* aligned along a line of cylinders with an axis 61, so that the end areas of the transfer passageways 62 of each of the cylinders are aligned in a direction 66 parallel to axis 61 of the line of cylinders, and mounted in a lateral arrangement relative to this line of cylinders.

The means for restricting the passage of compressed air in the direction of transfer openings 65 of each of the cylinders are constituted by plugs 67*a*, 67*b*, 67*c* with a cylindrical shape mounted to rotate around axis 66, each inside a portion of the end of transfer passageway 62 of the corresponding cylinder.

Preferably, the plugs 67*a*, 67*b*, and 67*c* are constituted by the three successive parts of a cylindrical rod 69, in each of which parts an opening or port 70 is provided over a length essentially corresponding to the length of the portion of the end areas of the transfer passageway 62.

Figure 12A:
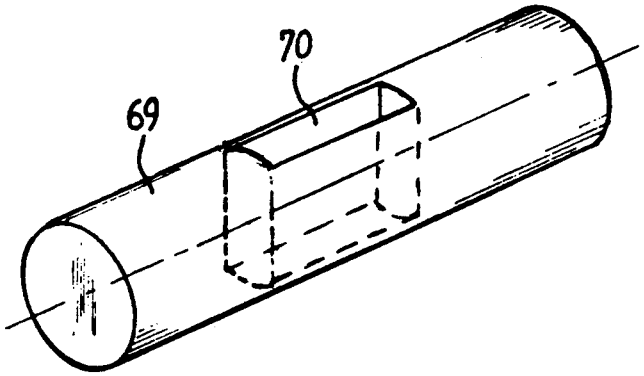
FIGS. 12A and 12B are perspective views of two embodiments of a rotary plug used in an engine in accordance with the present invention.
Figure 12B:
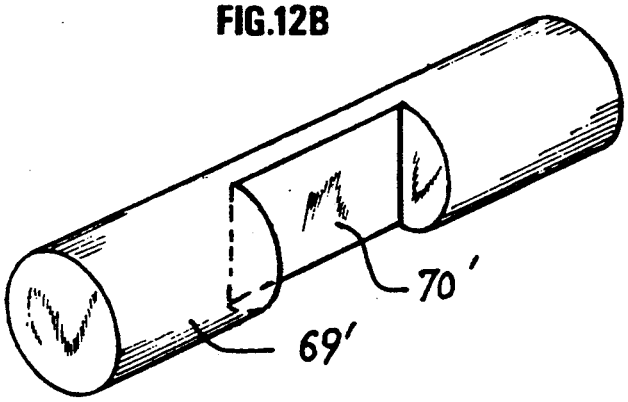

In FIGS. 12A and 12B, two versions of the embodiment of opening or port 70 through the cylindrical rod 69 are shown.

In FIG. 12A, the opening or port 70 is an opening for a passageway running diametrically and traversing cylindrical rod 69 at a central part thereof.

In FIG. 12B, the opening or port 70' is a port produced by machining a lateral part of the cylindrical rod 69.

Cylindrical rod 69, as shown in FIG. 9, is rotatably mounted in the engine block and arranged in direction 66 so that the cylindrical rod 69 traverses, for their entire length, the ends of transfer passageways 62 of each of cylinders 60*a*, 60*b* and 60*c*. Successive parts 67*a*, 67*b*, and 67*c* of rod 69 constitute the rotary plugs traversed by openings 70 and are each located in the end portion of a transfer passageway 62.

Adjusting the position of rod 69 around its axis 66 as a function of an operating parameter of the engine makes it possible simultaneously to locate the rotary plugs, each associated with one cylinder of the engine, in the desired position.

Figure 10:
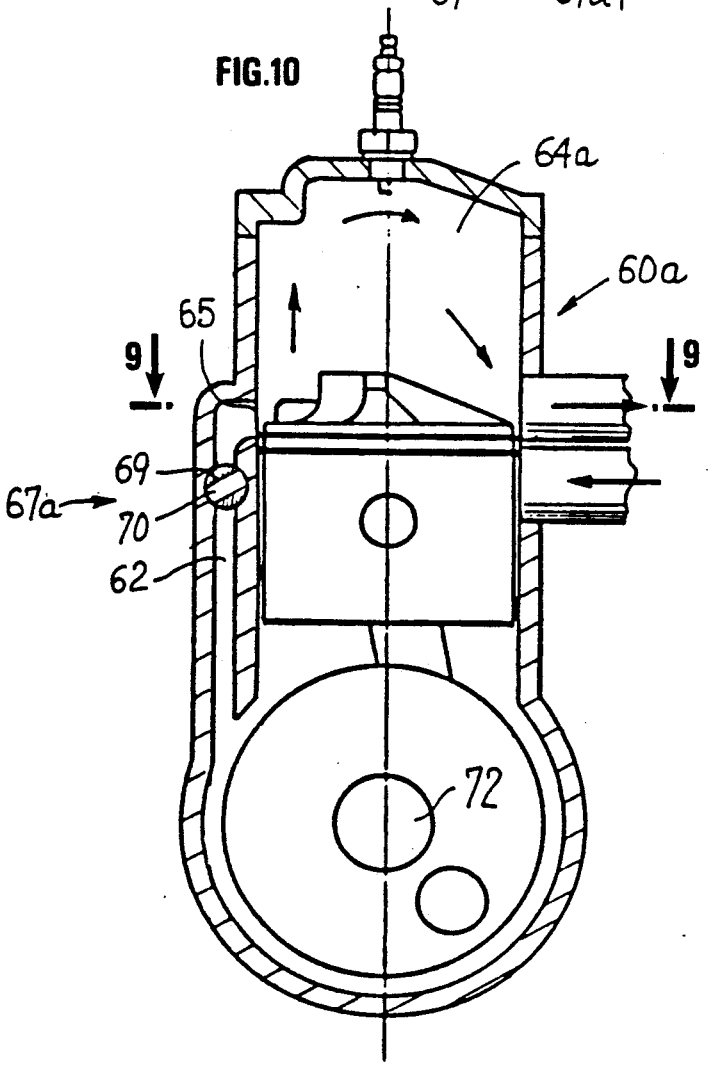
FIG. 10 is a cross-sectional view taken along the line 10—10 in FIG. 9.

As shown in FIG. 10, during its rotation, plug 67*a* can ensure complete opening of transfer passageway 62 or, conversely, more or less complete closure of this passageway, causing restriction or suppression of the flow of compressed air in the direction of transfer openings 65.

Restriction of the compressed air flow in the direction of transfer openings 65 makes it possible to improve the pneumatic injection of fuel into combustion chamber 64*a*.

Figure 11:
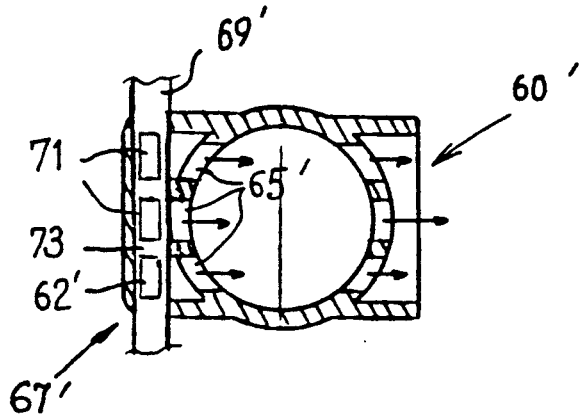
FIG. 11 is a cross-sectional view according to a variation of the second embodiment of FIG. 9.

FIG. 11 shows a variation of an embodiment of a cylinder 60' of an engine according to the invention with cross scavenging and with flow restriction provided by a means composed of a rotary plug.

In this embodiment, end 62' of the transfer passageway is separated into several successive parts by partitions 73, with each of the parts of passageway 62' communicating with a transfer opening 65' in the cylinder 60'.

In this case, the rotary plug 67' for reducing the passageway in the end of transfer passageway 62' of cylinder 60' is constituted by a portion of rod 69' rotatably mounted in cylinder block 60' and in partitions 73, with the rod comprising an opening 71 at each of the parts of the end of the transfer passageway 62' located opposite a transfer opening 65'.

The operation of a multicylinder engine comprising juxtaposed cylinders like cylinder 60' is identical to the operation of the multicylinder engine shown in FIGS. 9 and 10.

In all cases, the two-cycle multicylinder engine according to the invention improves pneumatic injection in each of the cylinders by restricting the flow of compressed air at the end of the transfer passageway communicating with the transfer openings that communicate with the combustion chamber.

This result is obtained in simple fashion for the set of engine cylinders arranged in line by using means for restricting the flow of compressed air that are aligned in a direction parallel to the axis of the cylinder line and arranged laterally relative to this cylinder line.

These flow-restricting means may be assembled or connected or machined on a single operating shaft rotatably mounted in the cylinder block of the engine.

Machining the engine cylinder block is facilitated by the fact that the end portions of the transfer passageways of the various cylinders are aligned in a direction parallel to the axis of the cylinder line.

In addition, the means for restricting the air flow in the transfer passageways may be regulated in simple fashion by having the adjustment keyed to a single operating shaft.

Finally, the multicylinder engine according to the invention has a compact design, with the various cylinders being juxtaposed to constitute a line of cylinders, with an inter-axis distance of a length only slightly greater than the passageway for the cylinders.

The invention is not limited to the embodiments that have been described.

It is therefore possible to imagine other embodiments of the means for restricting the flow of compressed air at the outlet of the transfer passageways, as a function of the shape of the end portion of these passageways communicating with the transfer openings.

It is likewise possible to imagine devices for regulating these means as a function of an operating parameter of the engine, of any type whatsoever.

When the flow-restricting means are constituted by distributors with translationally movable handles, the drive shaft is translationally displaced by mechanical, hydraulic, or pneumatic means.

Finally, the invention can be used on any multicylinder two-cycle engine with cross scavenging and pneumatic injection.

I claim:

1. Two-cycle engine comprising at least one cylinder, a piston movably mounted in said cylinder, a crankcase communicating with one end of the cylinder and comprising a means for admitting air into the crankcase, at least one intake passageway for introducing non-carburetted air into the cylinder, said at least one intake passageway communicating the crankcase with a transfer opening in the cylinder, means for pneumatically injecting fuel into the cylinder including a pneumatic injector, supply and metering means for supplying and metering the pneumatic fuel injector, a passageway for supplying the pneumatic injector with compressed air to atomize the fuel, said passageway being connected to the crankcase by a valve and a container for accommodating compressed air connected to the pneumatic injector by said passageway, an exhaust passageway connected to the cylinder by an exhaust opening located in an offset position in a direction of travel of the piston relative to the transfer opening of the cylinder, means for restricting a flow in the at least one intake passageway, and means for regulating an opening and closing of said means for restricting as a function of at least one engine operating parameter.

2. Two-cycle engine according to claim 1, wherein said means for restricting includes a butterfly valve located inside said at least one intake passageway at a position near the cylinder.

3. Two-cycle engine according to one of claims 1 or 2, wherein said means for restricting is connected by an articulated mechanical assembly to a further flow restricting means located in a passageway for admitting air to the crankcase.

4. Two-cycle engine according to one of claims 1 or 2, wherein said means for regulating includes a motor means, and wherein an electronic means for measuring the at least one engine operating parameter in response to a speed of or load on the engine and for providing a control signal to said motor means so as to selectively open and close said means for restricting.

5. Two-cycle engine according to claim 1, comprising at least two cylinders of a cross scavenging type arranged in line, transfer passageways connected to combustion chambers of the respective cylinders being, wherein ends of the respective transfer passageways are substantially aligned in a direction parallel to an axis of a cylinder line, and wherein means for restricting the flow is arranged in each of the transfer passageways, said means for restricting being aligned along a predetermined operating axis arranged in a direction parallel to the axis of the cylinder line.

6. Two-cycle engine according to claim 5, wherein said means for restricting arranged in each of the transfer passageways include a single operating shaft rotatably mounted on the operating axis parallel to the axis of the cylinder line in an engine cylinder block.

7. Two-cycle engine according to claim 6, wherein said means for restricting include aligned shaft ends having butterfly valves mounted thereon for regulating the flow of compressed air in end portions of the respective transfer passageways.

8. Two-cycle engine according to claim 6, wherein said means for restricting includes a single butterfly valve mounted at each end of a shaft and located in an end portion of the transfer passageway of the respective cylinders of the engine.

9. Two-cycle engine according to claim 7, further comprising partition means disposed at an end part of each of the transfer passageways for dividing the respective transfer passageways into several parts, each part of the end part of the respective transfer passageways being located opposite a transfer opening of the cylinder and wherein each end of the shaft includes a plurality of butterfly valves each located in a portion of the of the transfer passageway located opposite a transfer opening.

10. Two-cycle engine according to one of claims 5 or 6, wherein said means for restricting includes rotary plugs fashioned as a cylindrical rod mounted in the cylinder block of the engine to rotate around an axis parallel to the axis of the cylinder line of cylinders and comprising transverse openings in positions corresponding to portions of end portions of the transfer openings of each of the cylinders of the engine.

11. Two-cycle engine according to claim 10, wherein said openings are machined in a central part of said cylindrical rod in a diametrical direction.

12. Two-cycle engine according to claim 10, wherein said openings are fashioned as ports milled in a lateral surface of said cylindrical rod.

13. Two-cycle engine according to claim 10, further comprising partition means disposed at ends of the transfer passageways for dividing the respective transfer passageways into a plurality of parts, each part of the respective ends of the transfer passageways communicating with a transfer opening, and wherein said rod comprises sets of openings at each end of a transfer passageway of a cylinder, each of said openings being disposed in a portion of the end of the transfer passageway communicating with the transfer opening.

* * * * *